United States Patent [19]

Miekka et al.

[11] Patent Number: 4,764,229

[45] Date of Patent: Aug. 16, 1988

[54] SENSITIZATION OF INORGANIC OXIDIZER EXPLOSIVES

[76] Inventors: Fred Miekka; Jim Miekka, both of 199 Goodman's Hill Rd., Sudbury, Mass. 01776

[21] Appl. No.: 75,545

[22] Filed: Jul. 20, 1987

[51] Int. Cl.[4] ..... C06S 45/02

[52] U.S. Cl. ..... 149/21; 149/2; 149/38; 149/43; 149/44; 149/101; 149/104; 149/112; 149/88

[58] Field of Search ..... 149/38, 43, 44, 88, 149/101

[56] References Cited

U.S. PATENT DOCUMENTS

| | | | |
|---|---|---|---|
| 3,345,224 | 10/1967 | Griffith | 149/38 |
| 3,580,750 | 5/1971 | Griffith | 149/38 |
| 3,580,751 | 5/1971 | Griffith | 149/38 |

*Primary Examiner*—Stephen J. Lechert, Jr.

*Attorney, Agent, or Firm*—George E. Kersey

[57] ABSTRACT

Sensitized inorganic nitrate mixtures with high brisance are provided in which oxygen balance is attained by the incorporation of aluminum dust and hydrocarbons. Cap sensitivity is achieved by adding an organic nitrate. The resultant mixtures have a low tendency to sweat and cause headaches.

20 Claims, No Drawings

SENSITIZATION OF INORGANIC OXIDIZER EXPLOSIVES

BACKGROUND OF THE INVENTION

This invention relates to relatively insensitive explosives and more particularly to the sensitization of such explosives.

A typical insensitive explosive is provided by inorganic nitrates. One such explosive is known as ANFO, or Ammonium Nitrate Fuel Oil. ANFO formed from (94%) Ammonium Nitrate and (6%) Fuel Oil was first used on the Mesabi Range in 1955 in connection with blasting for iron ore deposites. ANFO will not react explosively by itself, but will explode when energized by a high energy booster. A typical use is to fill voids in bore holes.

Since 1955 there have been numerous modifications in ANFO seeking to facilitate the initiation of the explosive reaction without adverse consequences.

One modification of ANFO is provided by Slurried Blasting Agents or SBA's. They contain ANFO with water, a gelling agent, an emulsifier, and a sensitizer. An example is provided in U.S. Pat. No. 3,113,059 in which aluminum and/or trinitrotoluene (TNT) are the principal sensitizers, Gaur (ox gum) is a thickener, and ethylene glycol is an emulsifier. SBAs have a high packing density due to their fluidity but require a strong booster for detonation.

They are also cap-sensitive explosives based on ANFO. An example is the dry seismic explosive described in U.S. Pat. No. 4,528,049. Hexamine and its nitramine derivatives are used to sensitize the composition. Small quantities of aluminum provide an additional sensitizer.

There are ammonium nitrate-hydrocarbon blasting compositions as well. Of particular interest is U.S. Pat. No. 3,580,753 in which the main explosive sensitizer is TriMethylol Ethane TriNitrate or TMETN. TMETN is oxygen deficient and therefore acts as a reducing agent for ammonium nitrate. To assure appropriate cap sensitivity, a substantial amount of TMETN is needed, which leads to an exudate of the TMET known as sweating.

Unfortunately the addition of hydrocarbons generally tends to the reduction of sensitivity. The resultant detonation velocities are 4000 meters per second or less.

Accordingly it is an object of the invention to enhance the sensitivity of relatively insensitive high explosives such as inorganic nitrates. A related object is to do so for ammonium nitrate.

Another object of the invention to increase the detonation velocities of relatively insensitive explosives such as ammonium nitrate.

A further object of the invention is to increase the sensitivity of explosives such as ammonium nitrate without objectionable sweating. A related object is to realize explosive mixtures that do not readily cause headaches from handling.

A still further object is to realize low cost explosives with high detonation velocities and long shelf lives.

Yet another object is to realize explosive mixtures that have wide ranges of sensitivity and brisance.

SUMMARY OF THE INVENTION

In accomplishing the foregoing and related objects the invention provides an explosive mixture in which an inorganic nitrate is sensitized by the combination of a liquid, a hydrocarbon, a metallic powder and an organic nitrate in liquid form.

In accordance with one aspect of the invention, the inorganic nitrate is ammonium nitrate; the metallic powder is aluminum or magnesium; and the organic nitrate sensitizer is a liquid polynitrate selected from the class of di- and tri-nitrates.

The ammonium nitrate desirably is present in an amount ranging from about 55 to about 90 per cent by weight. The powdered metal is preferably in an amount ranging from about 2 to about 16 per cent by weight. The liquid hydrocarbon is present in an amount ranging between about 1 and 5 per cent by weight and the organic nitrate ranges from about 6 to 30 per cent by weight.

In accordance with another aspect of the invention, the explosive mixture includes an antacid buffer to counteract mixture acidity. The antacid substance is desirably a carbonate, including mono-and bi-carbonates, and is present in an amount of about 1 per cent by weight of the total mixture. The buffer impedes the deterioration of the explosive mixture on aging.

In accordance with a further aspect of the invention the liquid hydrocarbon sensitizer is selected from the class of petroleum derivitives including mineral oils and spirits. The spirit Naphtha fraction of petroleum between gasoline and kerosene; fuel oil petroleum distilates that are usable for heating and diesel fuel; and paraffin wax.

DETAILED DESCRIPTION

Explosives in accordance with the invention are aluminized mixtures of ammonium nitrate and hydrocarbon oils that do not contain water and are rendered cap sensitive by blasing oils such as ethylene glycol dinitrate and glyceryl trinitrate (nitroglycerin). The blasting oils allow good packing and a consistency that will not produce dust.

The hydrocarbon oils reduce the extent of exudate of the blasting oils from the mixture. This reduces the explosion hazard associated with "sweating". The reduction in sweating, and hazard, is increased to the extent of the miscibility of blasting and hydrocarbon oils.

The present invention has a moist consistency provided by liquid hydrocarbons and liquid sensitizers. A suitable sensitizer is ethylene glycol dinitrate or nitroglycerin. In general, an explosive sensitized in accordance with the present invention is not oxygen deficient and therefore can be added independently of the other ingredients without altering oxygen balance. Other hydrocarbons can be added as further sensitizers. The resultant detonation velocities are believed to be well over 5000 meters per second.

Other aspects of the invention will be apparent from the nonlimiting examples described below which clarify the nature and scope of the invention.

EXAMPLE 1

250 grams of fertilizer grade ammonium nitrate were ground into "prills" of small bead-like pellets and sifted through a #40 mesh screen. 89.5 grams of sifted powder were placed in a container to which were added 3.5 grams of #2 fuel oil and 7.0 grams of fine aluminum powder. The contents were thoroughly mixed.

25 grams of the mixture were then placed in a 3.0"×1.0" paper tube. A blasting cap was prepared by placing 1.0 gram of hexamethylene triperoxide diamine (HMTD) in a 2.5"×0.25" copper tube. The blasting cap was placed in the center of the paper tube and initiated by a fuse.

This mixture did not detonate, as indicated by its low volume and large amount of scattered residue.

EXAMPLE 2

1.5 grams of nitroglycerin and 0.1 grams of magnesium carbonate were added to the remaining contents of the container in Example 1 to form a 2.0% nitroglycerine mixture. The ingredients of the container were then thoroughly mixed as before.

25 grams of the 2.0% nitroglycerin mixture were placed in a 3.0"×1.0" paper tube and initiated as in the previous example. Again no detonation of the mixture was observed.

EXAMPLE 3

1.0 grams of nitrogylcerin were added to the remaining contents of the mixture from Example 2. 25 grams of this mixture were placed in a paper tube as before and initiated as previously described. This time a partial detonation was observed.

EXAMPLE 4

0.5 grams of nitroglycerin were added to the remaining 25 grams of the mixture from example 3 to make 6.0% nitroglycerin mixture. The mixture was placed in a paper tube and initiated as before. A complete detonation was observed.

EXAMPLE 5

An explosive was prepared from 3.2% #2 fuel oil, 6.3% aluminum powder, 10% nitroglycerin, 79.6% ammonium nitrate, and 1.0% magnesium carbonate. The explosive was initiated as described previously and exhibited approximately 70% strength in a lead block test, compared with Hercules* "Unigel" 60% dynamite and 100% gelatinite as the primary standards.

*Hercules Inc., 910 Market Street, Wilmington, Del. 19898.

EXAMPLE 6

A mixture was prepared in accordance with Example 5, except that nitrogylcerin was replaced by ethylene glycol dinitrate. The results were substantially the same.

EXAMPLE 7

A mixture was prepared according to Example 5, with the exception that half of the nitroglycerin was replaced by ethylene glycol dinitrate. This gave substantially identical results.

EXAMPLE 8

A mixture was prepared according to Example 5, with the exception that the magnesium carbonate was replaced by calcium carbonate. This gave substantially identical results.

EXAMPLE 9

An explosive mixture was prepared of 2.8% #2 fuel oil, 5.6% fine aluminum powder, 20% nitroglycerin, 70.6% ammonium nitrate, and 1.0% magnesium carbonate, according to the method of Example 5. This gave improved results.

EXAMPLE 10

An explosive mixture was prepared according to Example 9 with the exception that ethylene glycol dinitrate replaced the nitroglycerin. This gave substantially identical results.

EXAMPLE 11

An explosive mixture was prepared according to Example 9 with the exception that ethylene glycol dinitrate replaced half of the nitrogylcerin. This gave substantially identical results.

EXAMPLE 12

An explosive was prepared according to Example 9 with the exception that paraffin wax replaced fuel oil. This gave substantially identical results.

EXAMPLE 13

An explosive was prepared according to Example 9 with the exception that mineral spirits replaced fuel oil. This gave substantially identical results.

EXAMPLE 14

An explosive was prepared with 2.4% #2 fuel oil, 4.9% fine aluminum powder, 30% nitroglycerin, 61.7% ammonium nitrate, and 1.0% magnesium carbonate, prepared according to the method of example #1. This exhibited approximately 80% strength in lead block test results.

EXAMPLE 15

An explosive mixture was prepared according to Example 9, omitting the magnesium carbonate. The resultant mixture gave suitable results, but not as good as Example 9.

EXAMPLE 16

An explosive was prepared according to Example 9 with Naphtha substituted for fuel oil. The results were substantially as before.

EXAMPLE 17

An explosive was prepared according to Example 9 with diesel fuel substituted for fuel oil. The results were substantially as before.

EXAMPLE 18

An explosive was prepared according to Example 9 with mineral oil substituted for fuel oil with the same results as before.

EXAMPLE 19

An explosive mixture was prepared according to Example 14, with the exception that the nitroglycerin was replaced by ethylene glycol dinitrate, and gave identical results.

EXAMPLE 20

An explosive mixture was prepared according to Example 14, with the exception that ethylene glycol dinitrate replaced half of the nitroglycerin, and gave identical results.

EXAMPLE 21

The foregoing procedures were repeated with liquid hydrocarbon ranging from 1–5%; organic mixture ranging from 6–30%; a metallic powder ranging from 2–16% with the same results as before.

Those of ordinary skill in the art will recognize that other modifications may be made without departing from the spirit and scope of the invention.

What is claimed is:

1. An explosive mixture consisting of an inorganic oxidizer sensitized by a liquid hydrocarbon, metallic powder and a liquid non-reducing organic nitrate;

said liquid hydrocarbon and said liquid non-reducing nitrate being present in an amount completely absorbed by the other ingredients in order to reduce sweating by said explosive mixture.

2. An explosive mixture as defined in claim 1 wherein said inorganic oxidizer is ammonium nitrate, said metal is aluminum and said organic nitrate is a polynitrate selected from the class consisting of di- and tri-nitrates.

3. An explosive mixture as defined in claim 2 wherein said ammonium nitrate is present in an amount ranging from about 55 to about 90 percent by weight, the aluminum powder is present in an amount ranging from about 2 to about 16 percent by weight; said liquid hydrocarbon is present in an amount ranging between about 1 and 5 percent by weight and said liquid organic nitrate is present in an amount ranging between 6 and 30 percent by weight.

4. An explosive mixture consisting of an inorganic oxidizer sensitized by a liquid hydrocarbon, metallic powder and a liquid non-reducing organic nitrate;

said liquid hydrocarbon and said liquid non-reducing nitrate being present in an amount completely absorbed by the ther ingredients in order to reduce sweating by said explosive mixture;

and further including a buffer in the form of an antacid substance to counteract acidity of said mixture.

5. An explosive mixture as defined in claim 4 wherein said antacid substance is a carbonate including mono- and bi-carbonates, and is present in an amount of about 1 percent by weight of said mixture.

6. An explosive mixture as defined in claim 3 wherein said hydrocarbon is a sensitizer selected from the class consisting of mineral oil and spirit petroleum derivitives; the spirit naphtha fraction of petroleum between gasoline and kerosene; petroleum distilates usable as heating and diesel fuels; and paraffin wax.

7. An explosive mixture according to claim 2 consisting of, by weight, between 62% and 81% ground ammonium nitrate no greater than #40 mesh; between 10% and 30% nitroglycerin; between 5% and 10% aluminum powder; between 2% and 4% #2 fuel oil and about 0.1% magnesium carbonate.

8. An explosive mixture according to claim 7 consisting of, by weight, 79.6% ammonium nitrate, 10% nitroglycerin, 6.3% aluminum powder, 3.1% #2 fuel oil, and 1.0% magnesium carbonate.

9. An explosive mixture according to claim 7 consisting of, by weight, 71.6% ammonium nitrate, 20% nitroglycerin, 5.6% fine aluminum powder, 2.8% hydrocarbon including #2 fuel oil and wax, and 1.0% magnesium carbonate.

10. An explosive mixture according to claim 7 consisting of, by weight, 2.4% #2 fuel oil, 4.9% fine aluminum powder, 30% nitrogylcerin, 61.7% ammonium nitrate and 1.0% magnesium carbonate.

11. A mixture according to claim 2 wherein the ingredients are between 2% and 4% #2 fuel oil; between 4% and 10% fine aluminum powder; between 10% and 30% ethylene glycol dinitrate; between 62% and 81% ground ammonium nitrate and 1.0% magnesium carbonate.

12. A mixture according to claim 11 consisting of 3.1% #2 fuel oil, 6.3% fine aluminum powder, 10% ethylene glycol dinitrate, 79.6% ground ammonium, and 1.0% magnesium carbonate.

13. A mixture according to claim 11 consisting of 2.8% #2 fuel oil, 5.6% fine aluminum powder, 20% etylene glycol dinitrate, 71.6% ground ammonium nitrate, and 1.0% magnesium carbonate.

14. A mixture according to claim 11 consisting of 2.45% #2 fuel oil, 4.9% fine aluminum powder, 30% ethylene glycol dinitrate, 62.65% ground ammonium nitrate, and 1.0% magnesium carbonate.

15. A mixture according to claim 4 wherein the ingredients are between 2% and 4% #2 fuel oil; between 4% and 10% fine aluminum powder; between 1% and 30% nitroglycerin; between 1% and 30% ethylene glycol dinitrate; between 63% and 81% ground ammonium nitrate, and 1.0 percent magnesium carbonate.

16. A mixture according to claim 4 consisting of mineral spirits, aluminum powder, ethylene glycol dinitrate, and ammonium nitrate.

17. A mixture according to claim 15 consisting of 3.15% #2 fuel oil, 6.3% aluminum powder, 5% ethylene glycol dinitrate, 5% nitroglycerin, 79.55% ground ammonium nitrate, and 1.0% magnesium carbonate.

18. A mixture according to claim 15 consisting of 2.8% #2 fuel oil, 5.6% fine aluminum powder, 10% ethylene glycol dinitrate, 10% nitroglycerin, 70.6% ammonium nitrate, and 1.0% magnesium carbonate.

19. A mixture according to claim 15 consisting of 2.45% #2 fuel oil, 4.9% fine aluminum powder, 15% ethylene glycol dinitrate, 15% nitrogylcerin, 62.65% ammonium nitrate, and 1.0% magnesium carbonate.

20. A mixture according to claim 4 consisting 2.8% was, 5.6% fine aluminum powder, 10% ethylene glycol dinitrate, 10% nitroglycerin, 70.6% ammonium nitrate, and 1.0% magnesium carbonate.

* * * * *